United States Patent [19]

Suffi

[11] Patent Number: 4,919,622

[45] Date of Patent: Apr. 24, 1990

[54] INSULATION DISPLACING TERMINAL

[75] Inventor: Louis Suffi, Westchester, Ill.

[73] Assignee: Reliance Comm/Tex Corporation, Cleveland, Ohio

[21] Appl. No.: 330,621

[22] Filed: Mar. 30, 1989

[51] Int. Cl.[5] ..... H01R 4/24

[52] U.S. Cl. ..... 439/395; 439/391

[58] Field of Search ..... 439/389–407

[56] References Cited

U.S. PATENT DOCUMENTS

| | | | |
|---|---|---|---|
| 3,605,071 | 9/1971 | Sedlacek | 339/97 |
| 3,636,500 | 1/1972 | Sedlacek | 339/97 |
| 3,761,866 | 9/1973 | Sedlacek | 339/97 |
| 4,354,719 | 10/1982 | Weidler | 439/398 |
| 4,527,852 | 7/1985 | Dechelette | 439/398 |
| 4,682,835 | 7/1987 | Aujla | 439/395 |

*Primary Examiner*—David Pirlot

*Attorney, Agent, or Firm*—R. A. Blackstone, Jr.

[57] ABSTRACT

A clip-type electrical terminal has a base and at least two substantially parallel resilient cantilever beam members attached to the base and longitudinally projecting outwardly therefrom, the beam members being elongated in the direction of their projections from the base. The beam members are separated to form a gap therebetween and to define facing inner edges thereof. The beam members define outer ends of the terminal, which outer ends form a notch having a first pair of beam member edge portions that form a funnel-like angle defining a guide channel. A second pair of beam member edge portions are contiguous with the first-mentioned edge portions, such that the guide channel is coextensive with at least a portion of the gap formed between the beam members. This second pair of beam member edge portions also defines a wire-insulation slicer having sharp edges at the intersection of the second beam member edge portions and the first beam member edge portions such that an insulated wire, upon entering the notch, is guided by the notch and guide channel to the insulation slicer so as to have the insulation sliced therefrom as the wire passes through the guide channel.

6 Claims, 1 Drawing Sheet

FIG. 1
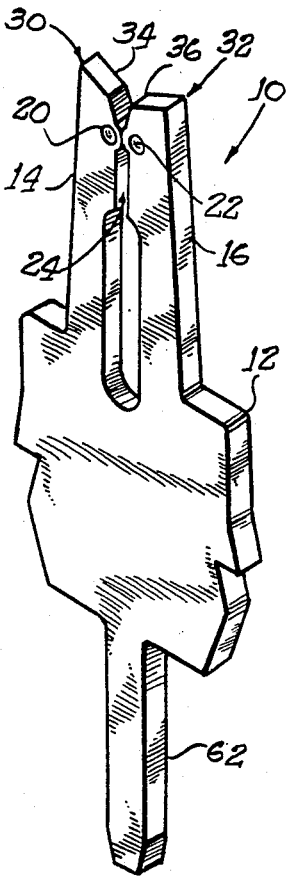
FIG. 2
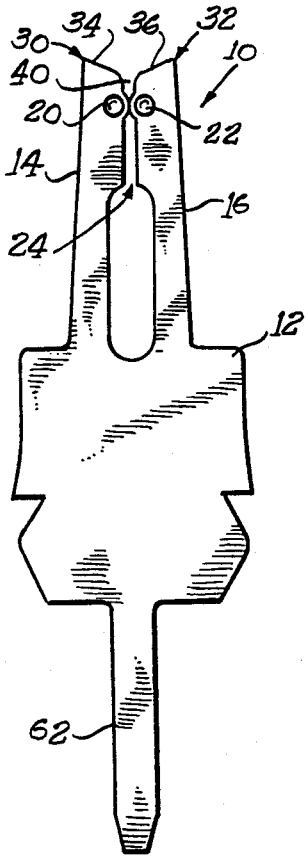
FIG. 3
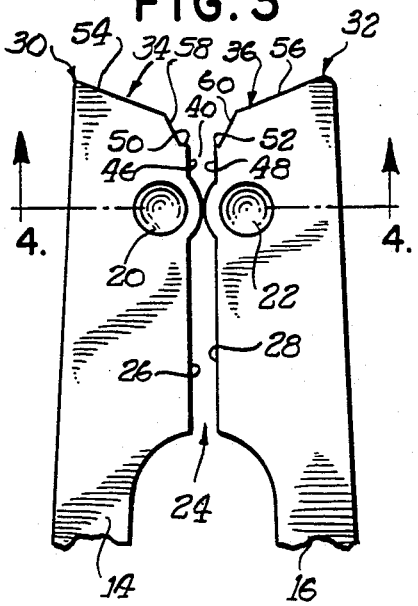
FIG. 4
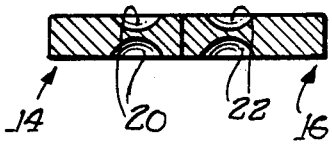
FIG. 5
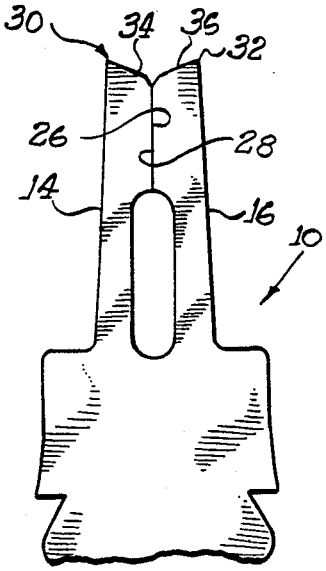
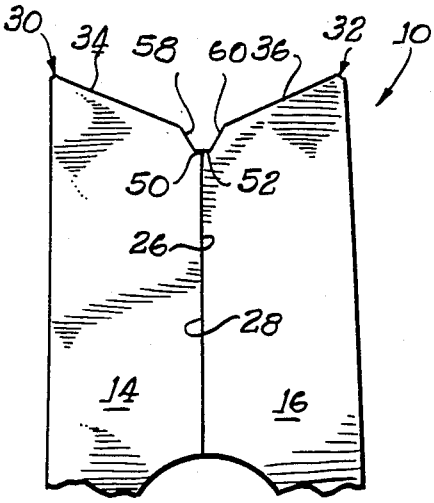
FIG. 6

INSULATION DISPLACING TERMINAL

BACKGROUND OF THE INVENTION

This invention relates generally to clip-type electrical terminals, and more particularly to an insulation displacement terminal of this type.

Generally speaking, insulation displacement clip-type terminals are devices for engaging a solid conductor insulated wire to make electrical contact therewith. These clip-type terminals are generally relatively flat pieces of metal having two integrally formed resilient arms which provide a conductor receiving slot therebetween. The insulated wire is forced into the slot, which is of a width considerably less than the diameter of the conductor. The process of inserting the conductor into the slot results in a penetration of the insulation so that electrical contact is obtained between the slot edges and the conductor. Wires may be quickly terminated by this sort of clip terminal because the need for prior stripping of the insulation is eliminated.

Clip-type terminals of this type are most frequently utilized in telecommunications applications wherein large numbers of conductors are to be terminated as expeditiously as possible. In typical installations, many hundred such terminals may be provided, mounted in suitable terminal blocks or the like, for receiving large numbers of telephone conductors for cross-connect and termination purposes.

In many terminals of this type, the penetration of the insulation is achieved by a crushing of the insulation which may be combined with a certain degree of abrasion or tearing of the insulation resulting from the relative movement of the conductor with respect to the edges of the slot formed in the terminal. In many of these prior art devices the entry to the slot is a relatively smooth V-shaped opening such that the insulated wire exerts a camming action which forces the resilient arms apart. However, in such devices, all of the insulation is not necessarily removed around any given portion of the solid conductor. In some instances, and particularly with relatively small diameter wires, there may be some insulation remaining between the conductor surface and the slot edge, either in the form of discrete particles or in the form of a thin film, either of which may unacceptably increase the resistance of the connection.

In other terminals of this type, the insulation is cut by cutting edges which extend generally perpendicular to the axis of the conductor; however, cutting edges so placed usually also cut into the conductor core somewhat. This can lead to unacceptable conductor breakage or an unacceptably low pullout force of the conductor or both.

In the majority of communication-type uses as described above, it is desirable to provide for frequent insertion, removal and reinsertion of different conductors with respect to each such terminal. Thus, it is desirable that the terminals be reusable over many cycles of such use and still not only retain the ability to reliably displace insulation from the conductors, but also maintain good conductive contact with the conductor with sufficient pullout resistance. Such pullout resistance must be such as to prevent the conductor from coming out of the terminal due to vibration or pulling forces which may be exerted during other related work on adjacent conductors and/or equipment.

OBJECTS AND SUMMARY OF THE INVENTION

It is therefore an object of this invention to provide a clip type electrical terminal which provides for an accurate, consistent and repeatable method of termination of an insulated copper conductor.

A related object is to provide a method for making a clip-type terminal of the foregoing type.

Briefly, and in accordance with the foregoing objects, a clip-type electrical terminal in accordance with the invention, comprises a base, at least two substantially parallel resilient cantilever beam members attached to the base and longitudinally projecting outwardly therefrom, said beam members being elongated in the direction of their projections from the base; means for separating said beam members to form a gap therebetween and to define facing inner edges thereof; said beam members defining outer ends of the terminal, which outer ends form a notch having a first pair of beam member edge portions that form a funnel-like angle; a guide channel defined by said gap extending inwardly from said notch and between the facing inner edges of said beam members, a second pair of beam member edge portions comprising parts of said facing inner edges of said beam members bordering said guide channel portion being substantially parallel with each other and spaced apart and contiguous with the first-mentioned edge portions, such that said guide channel is coextensive with at least a portion of the gap formed between said beam members by said separating means; said second pair of beam member edge portions defining a wire-insulation slicer having sharp edges at the intersection of said second beam member edge portions and the first beam member edge portions such that an insulated wire, upon entering said notch, is guided by the notch and guide channel to the insulation slicer so as to have the insulation sliced therefrom as the wire passes through the guide channel; said base and said beam members being formed as a one-piece, substantially flat structure of substantially constant thickness. The invention also extends to a method of making such a terminal.

BRIEF DESCRIPTION OF THE DRAWINGS

The features of the present invention which are believed to be novel are set forth with particularity in the appended claims. The organization and manner of the operation of the invention, together with further objects and advantages thereof may best be understood by reference to the following description, taken in connection with the accompanying drawing in which like reference numerals identify like elements, and in which:

FIG. 1 is an enlarged perspective view of a clip-type terminal in accordance with the invention;

FIG. 2 is a front elevation of the terminal of FIG. 1;

FIG. 3 is a greatly enlarged partial view of the elevation of FIG. 2 illustrating further details thereof;

FIG. 4 is sectional view taken generally along the line 4—4 of FIG. 3;

FIG. 5 is a partial front elevational view illustrating the terminal of the invention at an intermediate step in the process of formation thereof; and FIG. 6 is a greatly enlarged partial view illustrating further details of the view of FIG. 5.

DETAILED DESCRIPTION OF THE ILLUSTRATED EMBODIMENT

Turning now to the drawings, and initially FIGS. 1–3 an insulation displacement, clip-type terminal in accordance with the invention is designated generally by the reference numeral 10. The terminal 10 comprises a base member or portion 12 from which project at least two substantially parallel resilient cantilever beam members 14, 16. The beam members 14, 16 project longitudinally outwardly from the base 12, and are elongated in the direction in which they project from the base 12. Separating means which, in the illustrated embodiment, comprise a pair of bosses or embossments or "dimples" 20, 22 (best viewed in FIG. 3) cause the beam members to spread or separate somewhat to form a gap or opening 24 therebetween, which gap also defines a pair of facing parallel and spaced apart inner edges 26, 28 of the respective beam members 14, 16.

These dimples or embossments form actual indentations in the metal material of the clip terminal 10 such that the material thereabout is deformed or extruded outwardly, to physically push or force the resilient beams 14, 16 somewhat apart. In this regard, and referring briefly to FIGS. 5 and 6, it will be seen that prior to the formation of the bosses or dimples 20, 22, the inner edges 26, 28 of the beam members 14, 16 actually abut along their length, such that there is no gap or opening 24 between the beam members.

The beam members 14, 16 also define outer ends 30, 32 of the terminal 10, which outer ends form a notch having a first pair of beam member edge portions 34, 36 that form a funnel-like lead-in portion. A guide channel 40 extends inwardly from the notch defined by edges 34, 36 and between the facing inner edges 26, 28 of the beam members.

This guide channel portion 40 actually comprises a portion of the gap 24 between edges 26 and 28, and further defines a second pair of beam member edge portions 46, 48 which are spaced apart and parallel and comprise respective portions of the inner edges 26, 28. These edges 46 and 48 are also contiguous with and extend inwardly of the notch formed by the edge parts 34 and 36. The guide channel 40 is therefore coextensive with at least a portion of the gap 24 formed between the beam members 14, 16 by the separating means 20, 22.

The second pair of beam member edge portions 46, 48 further define a wire insulation slicer having sharp edges at the intersections of the second beam member edge portions and first beam member edge portions 34, 36. These sharp edges are indicated by reference numerals 50, 52 in FIG. 3. Accordingly, the resilient separation of beams 14 and 16, together with the notch, guide channel and sharp edges described above are such that an insulated wire, upon entering the notch defined between edges 34 and 36 is guided by the notch and guide channel 40 into the insulation slicer at edges 50, 52 so as to have the insulation sliced therefrom as the wire passes through the guide channel 40. The sharp edges or corners 50, 52 thus displace the insulation and slice the insulation away from the conductor when the wire is pressed downwardly. The additional extrusions caused by the dimples 20, 22 may act to do additional removal or "clean up" of any remaining particles or portions of insulation about a copper solid conductor core of a wire as the wire is pressed therethrough.

After the wire has passed the dimples 20, 22 it is terminated and held by the resilient inward force between beams in the remaining portion of gap 24 between edges 26 and 28 as indicated in FIG. 3. This horizontal inward force will tend to displace any remaining insulation and also provides sufficient force to maintain good electrical connection and control pull-out or withdrawal force in accordance with the invention. Advantageously, the above-described arrangement also tends to shear away or cut away the insulation relatively cleanly in a single clean downstroke application. As mentioned above, other devices and methods often merely displace or crush the insulation.

In the embodiment illustrated herein, the notch formed between edges 34 and 36 includes a first notch portion which is defined between first edges 54 and 56 which, between them, form an obtuse angle, and a second notch portion extending inwardly of the first notch portion and into the guide channel 40. The second notch portion is defined between a further pair of edges 58, 60 which define an angle therebetween which is less than the obtuse angle defined between edges 54 and 56. In the embodiment illustrated herein, the obtuse angle between edges 54 and 56 is substantially on the order of 136° and the angle between edges 58 and 60 is substantially on the order of 80°.

It will be noted that the separating means comprising the bosses or indentations 20 and 22 are formed in the respective beam members 14 and 16 adjacent the facing inner edges 26, 28 thereof so as to deform the material of each beam member toward the correspondingly deformed material of the other, thereby causing the resilient beam members 14, 16 to spread apart and define or open up the gap 24 therebetween. The embossments or dimples 20, 22 are preferably formed at closely adjacent and facing locations and are aligned with each other at the respective edges 26, 28 which, as shown in FIGS. 5 and 6 prior to the dimple formation, are abutting edges.

In the illustrated embodiment, the remaining portions of the clip terminal 10 may be of various forms without departing from the invention. For purposes of illustrating one particular embodiment, the base 12 has been illustrated in the form of a tab for securing the clip terminal to a holder, as by wedging. Also extending from the base in a direction generally opposite the beam members 14, 16 is a thin, elongate wire-wrap type terminal end 62 which may extend oppositely outwardly of the terminal block or the like into which the clip connector is wedged or secured, to permit wire-wrap and/or solder connections at the opposite end of the terminal 10. However, the specific forms of the base 12 and wire-wrap terminal 62 may vary without departing from the invention, the foregoing being by way of illustration.

While particular embodiments of the invention have been shown and described in detail, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes and modifications as fall within the true spirit and scope of the invention.

The invention is claimed as follows:

1. A clip-type electrical terminal comprising a base, at least two substantially parallel resilient cantilever beam members attached to the base and longitudinally projecting outwardly therefrom, said beam members being elongated in the direction of their projections from the base; means for separating said beam members to form a gap therebetween and to define facing inner edges thereof; said beam members defining outer ends of the terminal, which outer ends form a notch having a first pair of beam member edge portions that form a funnel-like angle; a guide channel defined by said gap extending inwardly from said notch and between said facing inner edges of said beam members, a second pair of beam member edge portions comprising parts of said facing inner edges of said beam members bordering said guide channel portion being substantially parallel with each other and spaced apart and contiguous with the first-mentioned edge portions, such that said guide channel is coextensive with at least a portion of the gap formed between said beam members by said separating means; said second pair of beam member edge portions defining a wire-insulation slicer having sharp edges at the intersection of said second beam member edge portions and the first beam member edge portions such that an insulated wire, upon entering said notch, is guided by the notch and guide channel to the insulation slicer so as to have the insulation sliced therefrom as the wire passes through the guide channel; said base and said beam members being formed as a one-piece, substantially flat structure of substantially constant thickness; wherein said separating means comprises a pair of aligned bosses formed repectively in said two beam members adjacent said facing inner edges thereof so as to deform material of each said beam member toward the other to thereby cause said resilient beam members to spread apart to define said gap therebetween; said bosses being formed at an area of said beam members between said guide channel portion and a remaining portion of said gap in which said wire is held following the slicing of insulation therefrom.

2. A clip-type electrical terminal according to claim 1 wherein said notch includes a first notch portion that defines an obtuse angle and a second notch portion extending inwardly of said first notch portion and defining an angle which is less than said obtuse angle.

3. A clip-type electrical terminal according to claim 2 wherein said obtuse angle is substantially on the order of 136° and wherein said angle which is less than said obtuse angle is substantially on the order of 80 °.

4. A method of forming a flip-type electrical terminal comprising a base and at least two substantially parallel resilient cantilever beam members attached to the base and longitudinally projecting outwardly therefrom, said method comprising: forming said beam members in a resiliently abutting condition elongated in the direction of their projections from the base so as to be at least several times longer than wide, and such that said beam members define outer ends of the terminal; forming a notch at said outer ends having a first pair of beam member edge portions that define an angle therebetween; separating the beam members to form a gap between respective abutting inner edges thereof; forming in a first portion of said gap contiguous with and extending inwardly from said notch portion a guide portion comprising a pair of spaced, parallel and facing second beam member edge portions along at least a portion of said facing inner edges thereof; forming a wire-insulation slicer portion having sharp edges at the intersection of said first beam member edge portions and said second beam member edge portions such that an insulated wire, upon introduction through the notch, is guided by the notch and guide portion into contact with said slicer portion so that the insulation is sliced from the wire as it passes through the guide portion; and wherein said base and beam members are formed as a one-piece substantially flat structure of substantially constant thickness; wherein the step of separating said beam members comprises forming a pair of bosses in the respective beam members adjacent the respective abutting edges thereof so as to deform material of each of said beam members inwardly toward the other, said deformed material from each beam member contacting that from the other beam member and thereby pushing apart said resilient beam members somewhat to form said gap therebetween; said bosses being formed at an area of said beam members between said guide portion and a remaining portion of said gap in which said wire is held following the slicing of insulation therefrom.

5. A method according to claim 4 wherein the step of forming a notch further includes forming a first notch portion that defines an obtuse angle and a second notch portion extending inwardly from the first notch portion and defining an angle which is less than said obtuse angle.

6. A method according to claim 5 wherein said obtuse angle is substantially on the order of 136° and said angle which is less than said obtuse angle is substantially on the order of 80° .

* * * * *